US009453360B2

(12) United States Patent
Kim

(10) Patent No.: US 9,453,360 B2
(45) Date of Patent: Sep. 27, 2016

(54) WINDOW/ DOOR SYSTEM WITH FLAT TRACK HAVING "C"-SHAPED ROLLER SUPPORTS

(71) Applicant: Soon Seok Kim, Paju-Si (KR)

(72) Inventor: Soon Seok Kim, Paju-Si (KR)

( * ) Notice: Subject to any disclaimer, the term of this patent is extended or adjusted under 35 U.S.C. 154(b) by 0 days.

(21) Appl. No.: 14/622,872

(22) Filed: Feb. 15, 2015

(65) Prior Publication Data

US 2015/0240552 A1 Aug. 27, 2015

(30) Foreign Application Priority Data

Feb. 25, 2014 (KR) ..... 10-2014-0021779

(51) Int. Cl.

| | |
|---|---|
| ***E06B 3/46*** | (2006.01) |
| ***E05D 15/06*** | (2006.01) |
| ***E05D 15/08*** | (2006.01) |
| ***E06B 1/04*** | (2006.01) |
| ***E06B 3/02*** | (2006.01) |

(52) U.S. Cl.

CPC ..... *E06B 3/4636* (2013.01); *E05D 15/0665* (2013.01); *E05D 15/08* (2013.01); *E06B 1/04* (2013.01); *E06B 3/02* (2013.01); *E06B 3/4609* (2013.01); *E05D 15/0686* (2013.01); *E05Y 2201/11* (2013.01); *E05Y 2201/684* (2013.01)

(58) Field of Classification Search

CPC ..... E06B 3/4636; E06B 3/4609; E06B 3/42; E06B 3/04; E05D 15/0665; E05D 15/086

USPC ..... 52/204.51, 207, 209, 204.6, 656.4, 52/656.5, 656.7, 788.1

See application file for complete search history.

(56) References Cited

U.S. PATENT DOCUMENTS

| | | | | | |
|---|---|---|---|---|---|
| 4,219,971 | A * | 9/1980 | Mauroner | E05D 15/08 | 49/372 |
| 5,456,054 | A * | 10/1995 | Coupet | E06B 3/4663 | 49/458 |
| 6,718,695 | B1 * | 4/2004 | Park | E06B 3/4609 | 49/410 |
| 7,520,093 | B2 * | 4/2009 | Guhl | E06B 3/5454 | 52/204.1 |
| 8,683,747 | B2 * | 4/2014 | Kim | E06B 1/04 | 49/404 |
| 8,739,481 | B2 * | 6/2014 | Kim | E05D 15/0686 | 52/204.6 |
| 2012/0005975 | A1 * | 1/2012 | Kim | E06B 1/04 | 52/209 |
| 2014/0137476 | A1 * | 5/2014 | Kim | E06B 3/4609 | 49/305 |

FOREIGN PATENT DOCUMENTS

| | | | | |
|---|---|---|---|---|
| DE | 602384 C * | 9/1934 | ..... | E05D 15/0665 |
| KR | 100167124 | 2/1999 | | |
| KR | 1003244496 | 2/2002 | | |
| KR | 10090199400000 | 6/2009 | | |
| KR | 101055326 B1 * | 8/2011 | ..... | E05D 15/0686 |
| KR | 1010553260000 | 8/2011 | | |
| KR | 101216681 | 12/2012 | | |
| KR | 101302093 | 8/2013 | | |
| WO | WO 2012124865 A1 * | 9/2012 | ..... | E05D 15/0686 |

* cited by examiner

*Primary Examiner* — Katherine Mitchell
*Assistant Examiner* — Marcus Menezes
(74) *Attorney, Agent, or Firm* — Mark M. Friedman

(57) ABSTRACT

There is provided a window/door system with a flat track having "L"-shaped roller supports to provide a nice appearance and to improve air tightness and water tightness by reducing the number of grooves exposed on a window/door frame when a window/door is opened, by using the roller supports in a cross sectional shape of "L" which is open at one side.

6 Claims, 4 Drawing Sheets

WINDOW/ DOOR SYSTEM WITH FLAT TRACK HAVING "C"-SHAPED ROLLER SUPPORTS

CROSS-REFERENCE TO RELATED APPLICATION

This application claims the benefit of Korean Patent Application No. 10-2014-0021779, filed on Feb. 25, 2014, the disclosure of which is hereby incorporated herein by reference in its entirety.

BACKGROUND OF THE INVENTION

1. Field of the Invention

The present invention relates to a window/door system with a flat track and more particularly, to a window/door system with a flat track having a "ㄷ"-shaped roller support in which the roller support in a cross sectional shape of "ㄷ" having one side being open is used, to provide a nice appearance and to improve air-tightness and water-tightness by reducing the number of grooves shown on a window/door frame when a window/door is opened.

2. Description of the Related Art

Generally, a window or door (hereinafter, referred to as a window/door) installed in a building enables people inside to view the outside and has the functions of blocking noise, air and heat flow between the inside and outside. Further, a window/door ventilates polluted indoor air when it is open. A window/door is installed in a window/door frame in a certain size in the form of a sliding or hinged window/door. Following the trend that buildings have been luxurious, many different window/door systems have been developed for use to be easily maintained and managed, to be nice in appearance and to have functionality such as a security function.

In a conventional window/door system, a window/door frame exposes rail grooves where rails are installed and protrude, to allow a window/door to be opened or closed in a sliding motion. However, when people walk passing the rail grooves formed in the door frame, the rail grooves may be a dangerous obstruction causing them to stumble. Furthermore, since dust or any other foreign materials collect in the rail grooves, it is not easy to clean such dirty rail grooves. Specially, in a case where the window/door system is installed in a veranda, since a draft or rainwater easily comes into through the exposed rail grooves, the flow-tightness (air tightness, soundproof and drainage) is greatly reduced. When typhoon or heavy rain occurs, rainwater may flow inward.

Technology to solve the aforementioned problems has been presented in Korean Patent Nos. 167124 and 324496. However, since the structures presented in these patents are complicated, it is very difficult to connect and separate the window/door to and from the rail grooves. Further, since no structure to drain rainwater is specially provided, drainage is not good and rainwater flows backward to the inside. Furthermore, since the structure to block a draft is too simple, it is difficult to block drafts.

The applicant (inventor) of the present invention has repeated the research and development to solve not only the aforementioned problems but also many problems indicated during directly building window/door systems. As a result, the applicant (inventor) obtained Korean Patent Nos. 901994, 1055326 and 1216681 on the technology developed in relation to a rail-covered window/door system wherein a rail covering panel is mounted above rails giving a flat track look. According to this technology, the rails on which a window/door is sliding are not exposed to the outside. Furthermore, while the applicant (inventor) is now directly constructing a window/door system, he continues to develop a window/door system to improve air tightness, water tightness and heat insulation property and to be nice in appearance. The present invention has been also drawn during a series of such research and development.

SUMMARY OF THE INVENTION

Therefore, it is an object of the present invention to solve the above problems and to provide a window/door system with a flat track having "ㄷ"-shaped roller supports in which the roller support is structured to have a cross sectional shape of "ㄷ" having one side being open, thereby providing a nice appearance and improving air tightness and water tightness by reducing the number of grooves exposed between a window/door frame and a rail covering panel when the window/door is opened.

In accordance with an embodiment of the present invention, there is provided a window/door system with a flat track which comprises; a rail unit stably positioned lengthwise in a window/door frame, the rail unit including a rail panel in a flat shape, rails to allow the window/door to move in the sliding motion on the rail panel, and a rail cover joining channel expending to protrude upward from a top surface of the rail panel; a "ㄷ"-shaped roller support including rollers, a roller mounting section in a lower position under which the rollers are mounted, a window/door connecting section in a upper position, and a connection section connecting one end of the roller mounting section and one end of the window/door connecting section to each other, thereby forming a cross sectional shape of "ㄷ" which is open at one side, wherein a pair of the roller supports is installed such that the open sides of the "ㄷ" shapes face each other and the rollers are stably positioned on the rails of the rail unit; a rail cover having: a rail covering panel and rail cover joining flanges extending to protrude downward under the rail covering panel and to securely fit into the rail cover joining channel of the rail unit, wherein the rail cover is poisoned between in each "ㄷ"-shaped roller support installed to face each other such that the rail covering panel is positioned within each roller mounting section and each window/door connecting section; and a window/door to be securely connected by mounting a lower part of a window/door sash on the window/door connecting section.

Preferably, a pair of the window/door frames is installed, an insulator is integrally inserted between the pair of the window/door frames, and an insulation cap above the insulator is inserted to fit into the pair of the window/door frames.

Preferably, each window/door frame comprises: a pair of side parts positioned vertically, a connection part connecting lower ends of the side parts, rail unit connecting protrusions extending to protrude inward from the side parts above the connection part such that both ends of the rail panel of the rail unit are secured, and gasket receiving grooves formed to face each other in inner surfaces of upper ends of the side parts.

Preferably, the window/door connecting section of the roller support includes a mounting opening where mohair or a gasket is inserted to be mounted, and the top surface of the rail covering panel includes an indent formed at the position where the mohair or the front end of the gasket is in contact.

BRIEF DESCRIPTION OF THE DRAWINGS

The above and other features and advantages of the present invention will become more apparent to those of ordinary skill in the art by describing in detail preferred embodiments thereof with reference to the attached drawings in which.

Figure 1:
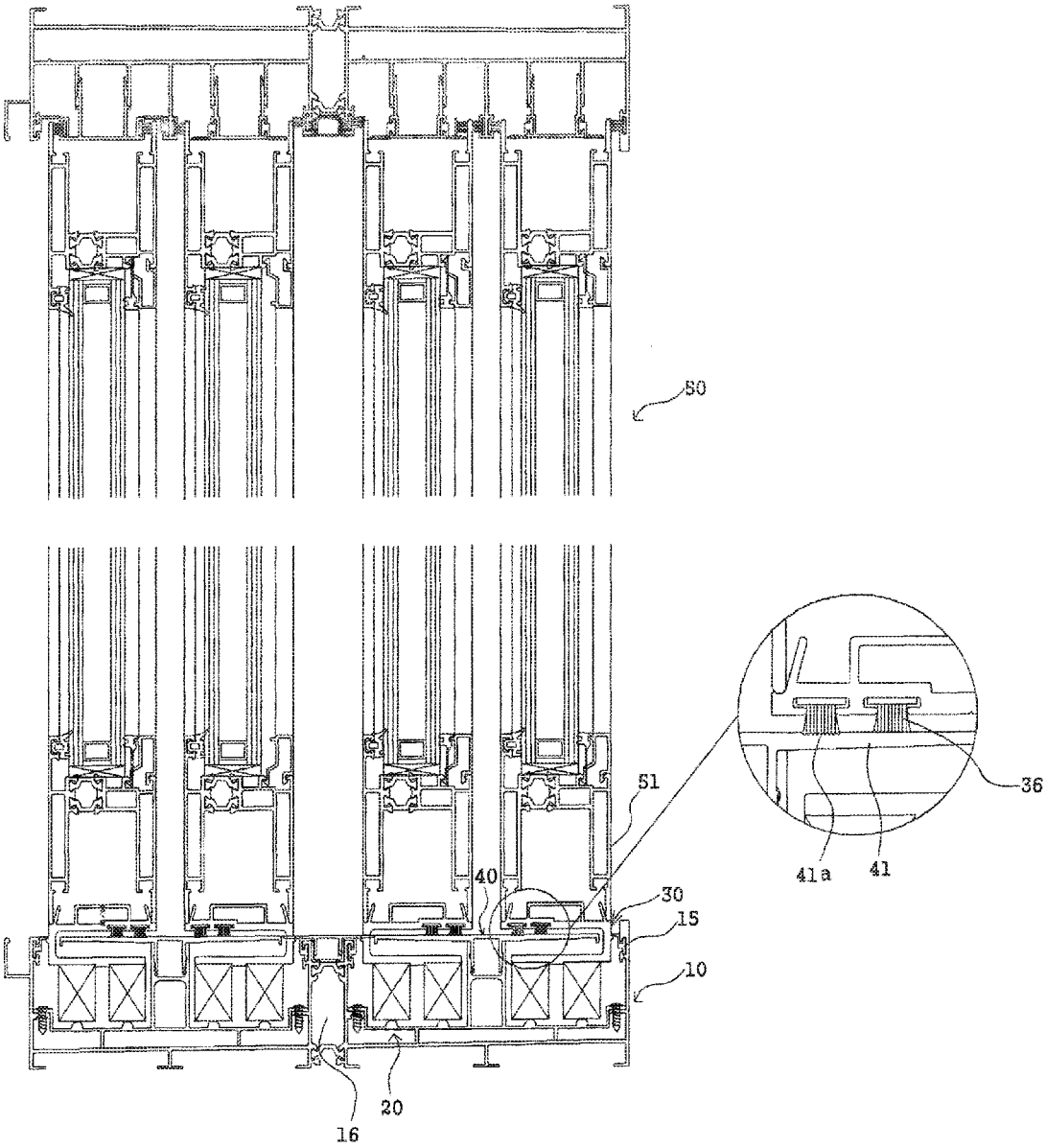
FIG. 1 is a cross-sectional profile view of a window/door system according to an embodiment of the present invention, which is applied to a double window/door structure.

| [Description of numbers for constituents in drawings] | |
|---|---|
| 10: window/door frame | |
| 13: rail unit connecting protrusion | |
| 14: gasket receiving groove | 15: gasket |
| 16: insulator | 17: insulation cap |
| 20: rail unit | 21: rail panel |
| 22: window/door weight support | 23: rail |
| 24: rail cover joining channel | |
| 30: roller support | 31: roller |
| 32: roller mounting section | |
| 33: window/door connecting section | |
| 34: guide protrusion | 35: gasket supporting protrusion |
| 38: mohair | |
| 40: rail cover | 41: rail covering panel |
| 42: rail cover joining flange | |
| 50: window/door | 51: window/door sash |
| 52: glass | |

DETAILED DESCRIPTION OF THE PREFERRED EMBODIMENT

The present invention will now be described more fully hereinafter with reference to the accompanying drawings, in which the preferred embodiments of the invention are shown so that those of ordinary skill in the art can easily carry out the present invention.

The greatest technical characteristic of a window/door system with a flat track according to the present invention is that a roller support is manufactured to have a cross sectional shape of "⊏". According to the present invention, the appearance is nice and the air tightness and water tightness are improved by decreasing the number of grooves (gaskets) exposed to be shown between a window/door frame and a rail covering panel to one (1) per window/door when the window/door is opened.

In this application of the present invention, the "flat track" means a rail covering structure in that rails on which the window/door slides are not shown in the window/door system since the rails are covered by the rail covering panel. According to this structure, the rails are never shown to the outside and only the top surface of the rail covering panel in a flat shape is shown when the window/door is open.

The window/door system according to the present invention has a basic constitution comprising: a window/door frame 10 fixedly installed in a building; a rail unit 20 fixedly connected to an inside of the window/door frame 10; a roller support 30 stably held and slid on the rail unit 20; a rail cover 40 connected to the rail unit 20 and secured in position to cover a rail; and a window/door 50 secured on the rail cover 40 and the roller support 30.

The window/door frame 10 is fixedly installed in the building. The window/door frame 10 to be vertically positioned includes a pair of side parts 11 forming both side walls, and a connection part 12 connecting lower ends of the side parts 11 to each other. A cross section of the window/door frame 10 has a rectangular shape which is open upward. Gasket receiving grooves 14 are formed to face each other in the inner surfaces of the upper ends of the side parts 11. Rail unit connecting protrusions 13 each extend to protrude inward from the side parts 11 lengthwise, above the connection part 12, so that both ends of a rail panel 21 of the rail unit 20 are connected to the rail unit connecting protrusions 13, respectively.

In the case of a double window/door structure, as shown in FIG. 1, one pair of the window/door frames 10 is installed inside and the other pair of the window/door frames 10 is installed outside. An insulator 16 is integrally inserted between each pair of the window/door frames 10 lengthwise. An insulation cap 17 is inserted to be secured on the insulator 16 between the window/door frames 10, so that the insulator 16 is not exposed upward.

The rail unit 20 is stably positioned lengthwise and fixedly secured inside the window/door frame 10. The rail unit 20 comprises: the rail panel 21 in a flat shape, rails 23 positioned on the rail panel 21 to allow the window/door 50 to slide, and a rail cover joining channel 24 extending to protrude upward from the rail panel 21 to be connected to rail cover joining flanges 42 of the rail cover 40. The rail unit 20 further comprises a pair of window/door weight supports 22 to safely support the weight of the window/door 50 to be mounted on and to be connected to the rail unit 20. The window/door weight supports 22 extend downward from the under surface of the rail panel 21 lengthwise and are spaced apart from each other at a proper distance. It is desirable that the window/door weight supports 22 are supported on the connection part 12 of the window/door frame 10.

Figure 2:
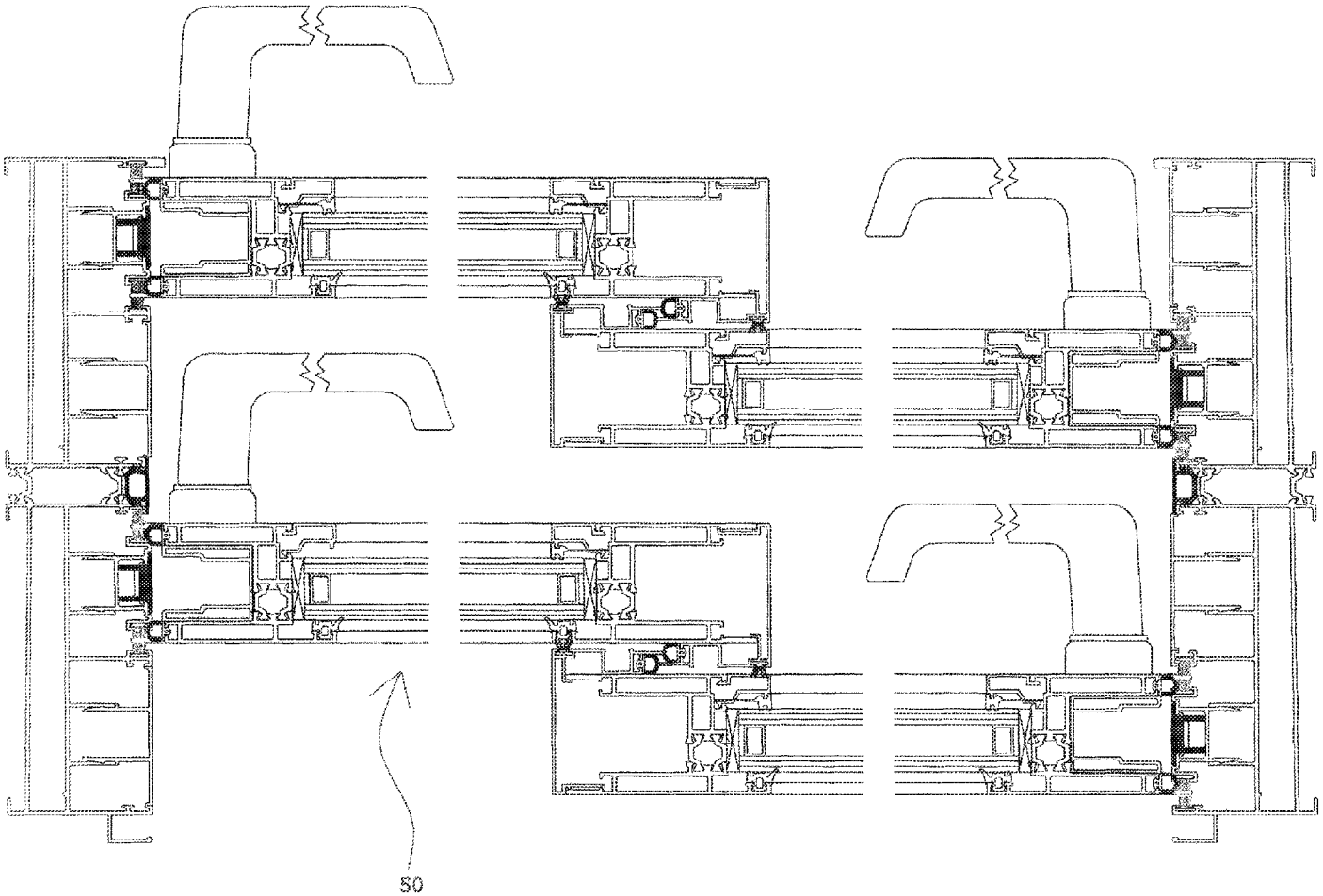
FIG. 2 is a top-down view of the window/door system of FIG. 1 with the upper railing removed.
Figure 3:
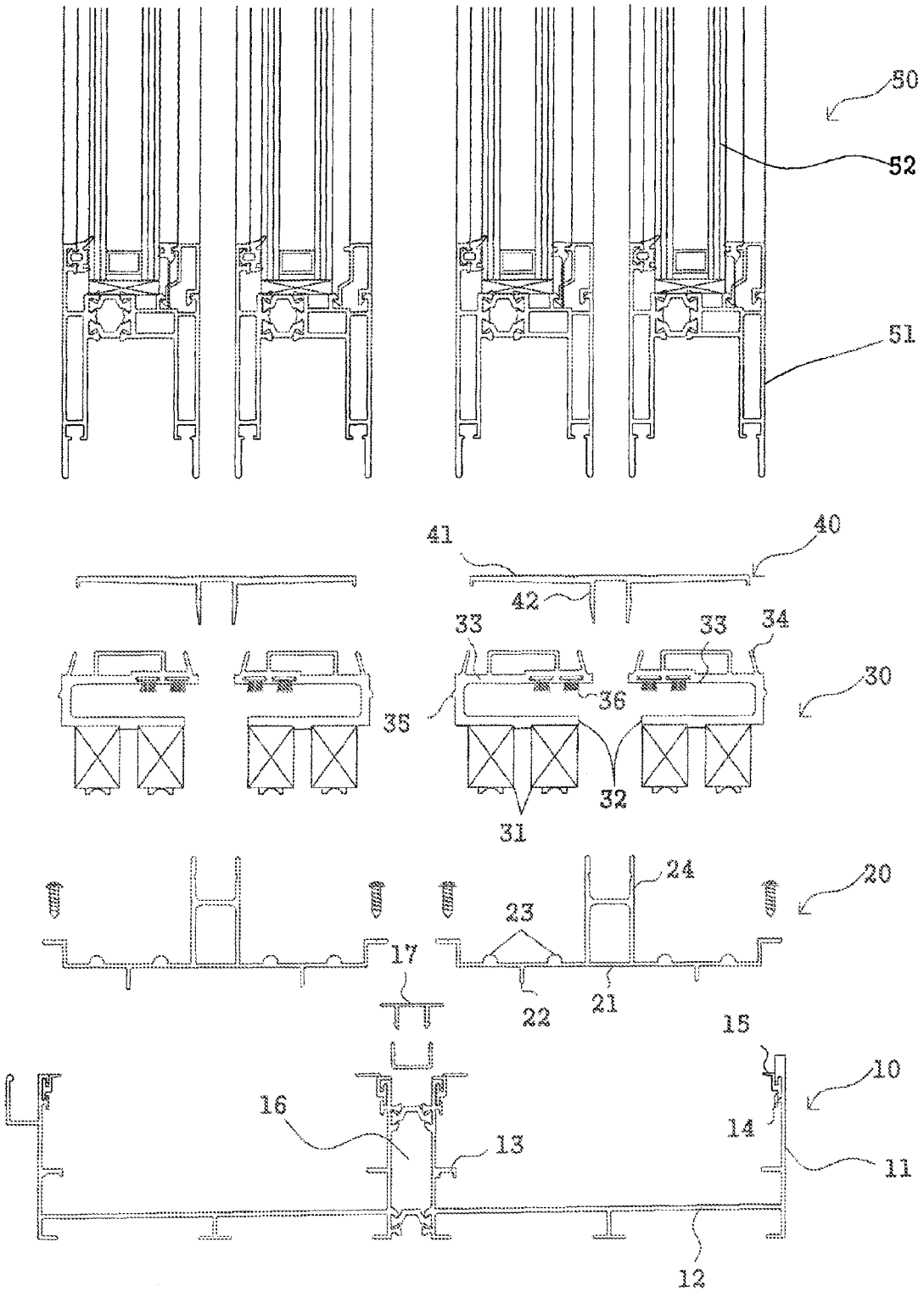
FIG. 3 is an exploded view of a lower part of the window/door system of FIG. 1.

The rails 23 are positioned lengthwise an either side of the rail cover joining channel 24. It is preferable that one pair of the rails 23 is positioned at one side of the rail cover joining channel 24 and the other pair of the rails 23 is positioned at the other side of the rail cover joining channel 24 in consideration of safety. The cross section of the rail cover joining channel 24 has an "H" shape. The opposite inner surfaces of the rail cover joining channel 24 include notches, respectively. Protrusions formed on the outer surfaces of the rail cover joining flanges 42 of the rail cover 40 are fit into the notches of the rail cover joining channel 24 by a one-touch manner (see FIG. 2).

The roller support 30 comprises: a window/door connecting section 33, a roller mounting section 32; and a connection section (not indicated by a drawing reference number) connecting one end of the window/door connecting section 33 and one end of the roller mounting section 32 to each other. Accordingly, the window/door connecting section 33, the roller mounting section 32 and the connection section between the window/door connecting section 33 and the roller mounting section 32 forms a cross sectional shape of "⊏" which is open at one side. In the roller support 30, rollers 31 are mounted, at equal intervals, under the roller mounting section 32. A pair of the roller supports 30 is mounted in one window/door frame 10 such that the open sides of the "⊏" shapes face each other and the rollers 31 are stably positioned on the rails 23 of the rail unit 20. The rollers 31 may be mounted in one (1) row (single roller) under the roller mounting section 32 but it is desirable that the rollers 31 are mounted in two (2) rows (a plurality of rollers) in consideration of safety.

The roller support 30 includes a gasket supporting protrusion 35 extending outward from an outer surface of the connection section positioned between the window/door connecting section 33 and the roller mounting section 32. A gasket 15 has an upper end being bent in the form of "¬" The gaskets 15 are connected in the gasket receiving grooves 14 formed in the inner surfaces of the upper ends of the side parts 11 of the window/door frame 10. When the window/door system is assembled, the bent end of the gasket 15 is positioned on the gasket supporting protrusion 35 to be locked with each other. Accordingly, the end of the gasket 15 is prevented from slipping into the gap between the side part 11 and the roller support 30, thereby improving the seal, air tightness and water tightness between the side parts 11 of the window/door frame 10 and the roller support 30.

When the window/door system with the flat track is assembled, the grooves where the gaskets 15 are positioned are exposed lengthwise between the side parts 11 of the window/door frame 10 and the ends of the roller supports 30. In the present invention, since the roller supports 30 in the "⊏" shape are used, only two (2) lines of the grooves which are formed at both ends lengthwise are shown per window/door frame 10, thereby providing a nice appearance and improving the water tightness and air tightness. However, in a case where a "□"-shaped roller support is used, the grooves in two (2) lines are shown along the both ends of each roller support and therefore, a total of four (4) lines of the grooves are shown per window/door frame 10. In this case, the appearance is not good and the water tightness and air tightness are lowered since the number of the grooves is increased.

The rail cover 40 comprises: a rail covering panel 41 in a flat shape; and a pair of rail cover joining flanges 42 extending downward from the rail covering panel 41. The rail cover joining flanges 42 are stably connected with the rail cover joining channel 24 of the rail unit 20 so that the rail cover 40 is secured to cover the rails 23 not to be shown upward. The rail covering panel 41 is positioned between and in each roller supports 30 which are installed such that the opening sides of the roller supports 30 face each other. That is, the rail covering panel 41 is positioned within the window/door connecting sections 33 and the roller mounting sections 32 (see FIG. 1).

The window/door connecting section 33 of the roller support 30 includes mounting openings where mohair 33 or gaskets are inserted to be mounted. On the rail covering panel 41, indents 41*a* are formed at the places where the mohair 36 or the front ends of the gaskets are in contact. When the window/door system is assembled, the mohair 36 or the front ends of the gaskets are inserted into the indents 41*a*, thereby filling the gap between the under surface of the window/door connecting section 33 of the roller support 30 and the top surface of the rail covering panel 41 and therefore improving the seal, air tightness and water tightness. Mohair or gaskets may be mounted in one roper support 30 in one (1) or two (2) rows. When these are mounted in two (2) rows, the mohair (or gaskets) may be mounted in all of the two (2) rows or the mohair may be mounted in one (1) row and the gaskets may be mounted in the other one (1) row.

The window/door 50 is fixedly connected by mounting a lower section of a window/door sash 51 on the window/door connecting section 33 of the roller support 30. Drawing reference number 52 not described indicates glass.

Guide protrusions 34 protrude and extend upward and obliquely at both ends of the window/door connecting section 33 of the roller support 30, to guide a location of connecting the window/door sash 51. Since the guide protrusions 34 are formed, the window/door 50 can be easily mounted and assembled at the correct location.

Figure 4:
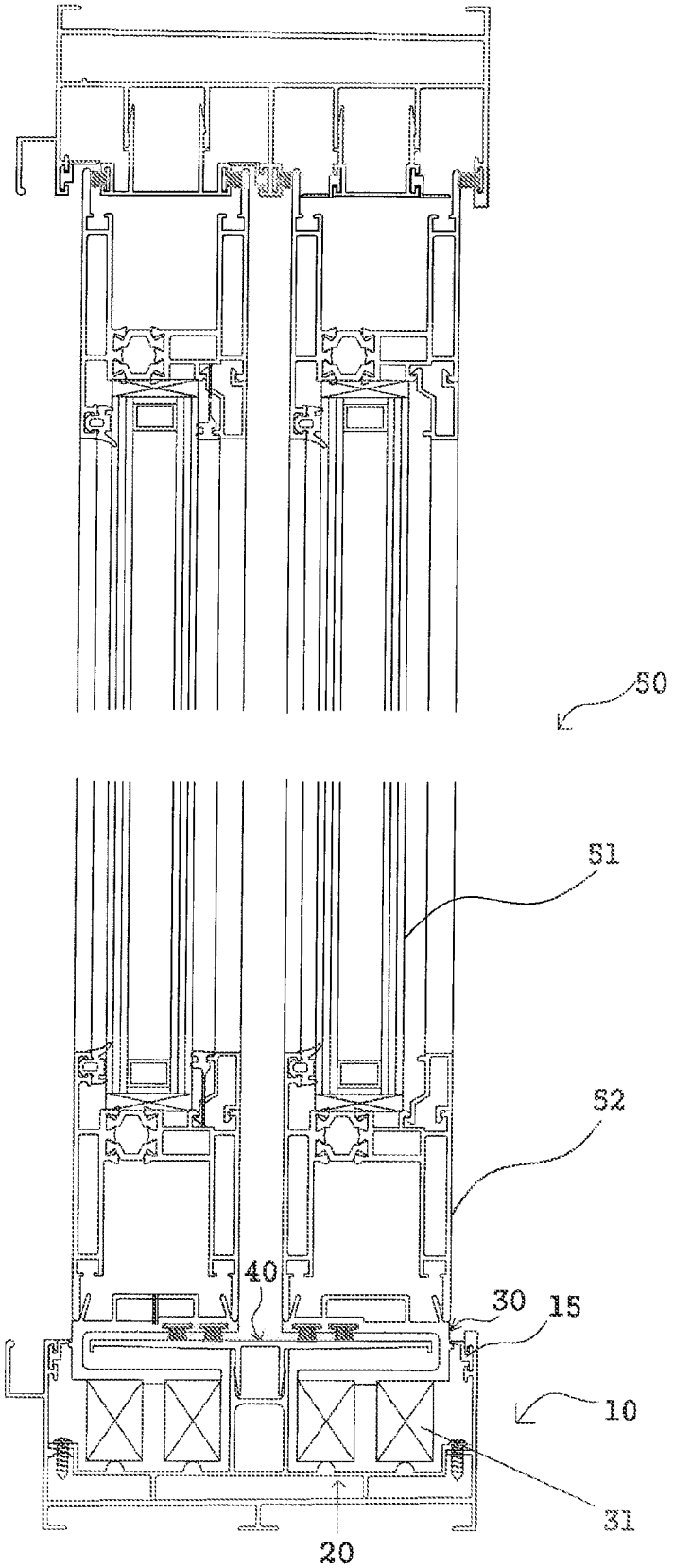
FIG. 4 is a cross-sectional profile view of the window/door system according to the embodiment of the present invention, which is applied to a single window/door structure.

FIG. 4 shows the window/door system with the flat track according to the present invention is used in a single window/door structure. The window/door system with the flat track used in the single window/door structure is identical with that used in the double window/door structure as shown in FIG. 1, except for only the insulator 16 and the insulation cap 17 installed between the window/door frames 10.

In the window/door system with the flat track as characterized above, since the cross section shape of the roller support is "⊏" which is opened at one side, only one (1) groove is exposed lengthwise between the window/door frame and the rail covering panel per window/door when the window/door is opened. Therefore, the appearance is nice in comparison with the conventional window/door system with the flat track where two (2) grooves are exposed per window/door. Further, since the number of the grooves to be exposed decreases, the air tightness and water tightness are improved. Additionally, since the number of the grooves to be exposed is reduced, the number of the gaskets to be inserted into the grooves is reduced, the material costs required in manufacturing and the management and maintenance costs can be reduced.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A window system with a flat track, which is structured to cover rails on which a window mounted onto a first window frame moves in a sliding motion, comprising:

a rail unit (20) positioned lengthwise in the first window frame (10), the rail unit (20) including a rail panel (21) in a flat shape, rails (23) to allow the window to move in the sliding motion on the rail panel (21), and a rail cover joining channel (24) extending to protrude upward from a top surface of the rail panel (21);

a "⊏"-shaped roller support (30) including rollers (31), a roller mounting section (32) in a lower position under which the rollers (31) are mounted, a window connecting section (33) in a upper position, and a connection section connecting one end of the roller mounting section (32) and one end of the window connecting section (33) to each other, thereby forming a cross sectional shape of "⊏" which is open at one side that includes two ends, wherein said two ends of the open side are spaced apart from one another, wherein a pair of the roller supports (30) is installed such that the open sides of the roller supports (30) face each other and the rollers (31) are rollably positioned on the rails (23) of the rail unit (20);

a rail cover (40) having: a rail covering panel (41) and rail cover joining flanges (42) extending to protrude downward under the rail covering panel (41) and to fit into the rail cover joining channel (24) of the rail unit (20), wherein the rail cover (40) is positioned in-between each "⊏"-shaped roller support (30), which are installed to face each other, such that the rail covering panel (41) is positioned within each roller mounting section (32) and each window connecting section (33); and the window (50) to be connected to the window system by mounting a lower part of a window sash (51) on the window connecting section (33).

2. The window system with the flat track having the "□"-shaped roller supports according to claim 1, further comprising a second window frame, an insulator (16) is integrally inserted between the first window frame (10) and the second window frame, and an insulation cap (17) above the insulator (16) is inserted to be fit between the first window frame (10) and the second window frame.

3. The window system with the flat track having the "□"-shaped roller supports according to claim 1, wherein the window frame (10) includes:

a pair of side parts (11) positioned vertically;

a connection part (12) connecting lower ends of the side parts (11);

rail unit connecting protrusions (13) extending to protrude inward from the side parts (11) above the connection part (12) such that ends of the rail panel (21) that each abut one of said pair of side parts (11) are secured; and gasket receiving grooves (14) formed to face each other in inner surfaces of upper ends of the side parts (11).

4. The window system with the flat track having the "□"-shaped roller supports according to claim 1, wherein the rail unit (20) further includes a pair of window weight supports (22) extending to protrude downward under the rail panel (21).

5. The window/door system with the flat track having the "□"-shaped roller supports according to claim 1, wherein the window connecting section (33) of the roller support (30) includes a mounting opening where mohair (36) or a gasket is mounted, and a top surface of the rail covering panel (41) includes an indent (41*a*) formed at a position where the mohair (36) or a front end of the gasket is in contact with the top surface of the rail covering panel (41).

6. The window system with the flat track having the "□"-shaped roller supports according to claim 1, wherein the roller support (30) further includes guide protrusions (34) extending to protrude upward and obliquely at lateral ends of the window connecting section (33), to serve as a positioning guide when connecting the window sash (51) when assembling the window (50).

* * * * *